US009994028B2

(12) United States Patent
Urakami et al.

(10) Patent No.: US 9,994,028 B2
(45) Date of Patent: Jun. 12, 2018

(54) INK HEATING DEVICE AND INKJET RECORDING DEVICE

(71) Applicant: Konica Minolta, Inc., Tokyo (JP)

(72) Inventors: Takeshi Urakami, Hachioji (JP); Seiji Yamaguchi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/513,860

(22) PCT Filed: Oct. 1, 2015

(86) PCT No.: PCT/JP2015/077893
§ 371 (c)(1),
(2) Date: Mar. 23, 2017

(87) PCT Pub. No.: WO2016/056450
PCT Pub. Date: Apr. 14, 2016

(65) Prior Publication Data

US 2017/0291422 A1 Oct. 12, 2017

(30) Foreign Application Priority Data

Oct. 10, 2014 (JP) ..... 2014-208472

(51) Int. Cl.
*B41J 2/165* (2006.01)
*B41J 2/175* (2006.01)

(52) U.S. Cl.
CPC ..... *B41J 2/175* (2013.01)

(58) Field of Classification Search
USPC ..... 347/17, 22, 36
See application file for complete search history.

(56) References Cited

U.S. PATENT DOCUMENTS 6,312,094 B1 * 11/2001 Ito ..... B41J 2/16523 347/22
2005/0052485 A1 * 3/2005 Komatsu ..... B41J 29/38 347/17

FOREIGN PATENT DOCUMENTS

JP 2009285907 A 12/2009

OTHER PUBLICATIONS

Written Opinion of PCT dated Dec. 22, 2015 from corresponding International Application No. PCT/JP2015/077893 and English translation; Applicant: Konica Minolta, Inc.; Total of 9 pages.
International Search Report dated Dec. 22, 2015 for PCT/JP2015/077893 and English translation.
Office Action dated Feb. 7, 2018 from corresponding Chinese Patent Application No. CN 201580054469.6 and English translation.

* cited by examiner

*Primary Examiner* — Lam Nguyen
(74) *Attorney, Agent, or Firm* — Lucas & Mercanti, LLP

(57) ABSTRACT

An ink heating device that is disposed on an inkjet recording device and heats ink includes an ink tank and at least one heater to heat the ink tank. The ink tank is an integrated unit of subtanks storing ink disposed along the longitudinal direction. The at least one heater heats both longitudinal ends of the ink tank to a temperature higher than a temperature of a central area in the longitudinal direction of the ink tank.

6 Claims, 5 Drawing Sheets

INK HEATING DEVICE AND INKJET RECORDING DEVICE

CROSS REFERENCE TO RELATED APPLICATION

This Application is a 371 of PCT/JP2015/077893 filed on Oct. 1, 2015, which, in turn, claimed the priority of Japanese Patent Application No. JP 2014-208472 filed on Oct. 10, 2014, both applications are incorporated herein by reference.

TECHNICAL FIELD

The present invention relates to an ink heating device and an inkjet recording device.

BACKGROUND ART

A known inkjet recording device includes inkjet heads that eject ink from nozzles onto a recording medium, to form an image on the recording medium.

Some of the ink used in the inkjet recording device has viscosity variable by heat. Smooth transfer of the ink from an ink tank to the inkjet heads and stable ejection of the ink from the inkjet heads are achieved through heating of the ink to appropriate temperatures before ejection.

A technique has been proposed for heating ink in an ink tank to appropriate temperatures with a heater disposed on the outer face of the ink tank feeding ink to inkjet heads (refer to Patent Document 1, for example).

PRIOR ART DOCUMENT

Patent Document

Patent Document 1: Japanese Unexamined Patent Application Publication No. 2009-285907

SUMMARY OF INVENTION

Problem to be Solved by Invention

Unfortunately, the heater in the traditional technique described above is disposed only on one of the longitudinal ends of the ink tank. Such a heater causes uneven heating of the ink distributed across the longitudinal direction of the ink tank. Thus, low-temperature ink is supplied to the inkjet heads and causes defects, such as ejection failure.

An object of the present invention is to provide an ink heating device that reduces unevenness in the temperature of ink in an ink tank in the longitudinal direction of the ink tank, and an inkjet recording device including the ink heating device.

Means for Solving the Problem

In order to achieve the object, the invention stated in item 1 is an ink heating device that is disposed on an inkjet recording device and heats ink, including: an ink tank that is an integrated unit of subtanks storing ink disposed along longitudinal direction; and at least one heater that heats the ink tank, wherein the at least one heater heats both longitudinal ends of the ink tank to a temperature higher than a temperature of a central area in the longitudinal direction of the ink tank.

The invention stated in item 2 is the ink heating device according to item 1, wherein, the at least one heater includes three heaters disposed in the central area and the both longitudinal ends of the ink tank, and the ink heating device further includes: a controller that independently controls heating temperatures of the heaters.

The invention stated in item 3 is the ink heating device according to item 1 or 2, wherein, the ink tank includes: a first subtank that is disposed in the central area; and second subtanks that are disposed in the both longitudinal ends and feed ink to an inkjet head of the inkjet recording device, and the at least one heater heat the second subtanks to temperatures higher than a temperature of the first subtank.

The invention stated in item 4 is the ink heating device according to item 3, wherein the first subtank includes a meandering flow channel through which ink flows and a storage portion that stores the ink from the flow channel and feeds the ink to the second subtanks.

The invention stated in item 5 is the ink heating device according to one of items 1 to 4, wherein the at least one heater is disposed on the external face of the ink tank.

The invention stated in item 6 is the ink heating device according to item 5, wherein, the at least one heater is a planer heating member, and the ink heating device further includes: an elastic member that is disposed on a face of the planer heating member opposite to the ink tank; a flat member that is disposed on a face of the elastic member opposite to the planer heating member; and a pressure fixing member that presses the flat member toward the ink tank.

The invention stated in item 7 is an inkjet recording device including: the ink heating device according to one of items 1 to 6; and an inkjet head that ejects ink heated by the ink heating device onto a recording medium.

Advantageous Effects of Invention

According to the present invention, it is possible to provide an ink heating device that reduces unevenness in the temperature of ink in an ink tank in the longitudinal direction of the ink tank, and an inkjet recording device including the ink heating device.

EMBODIMENTS FOR CARRYING OUT INVENTION

An inkjet recording device and an ink-tank heater according to embodiments of the present invention will now be described in detail with reference to the drawings. The scope of the invention should not be limited by the drawings. In the description below, components having the same functions or configurations are indicated by the same reference signs, and descriptions thereof are not repeated.

Figure 1:
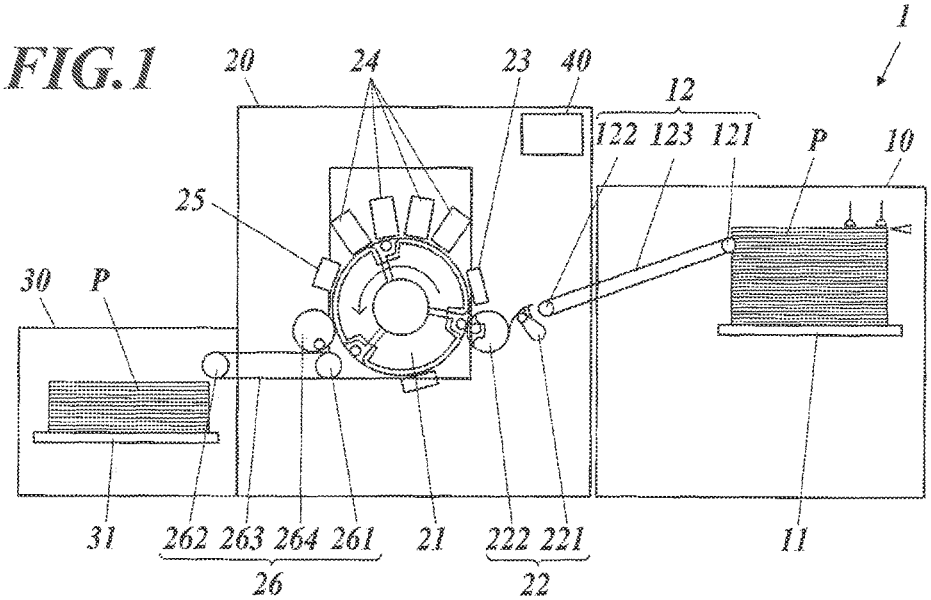
FIG. 1 illustrates the essential components of an inkjet recording device according to an embodiment of the present invention.

FIG. 1 illustrates the essential components of an inkjet recording device 1 according to an embodiment of the present invention.

The inkjet recording device 1 according to the present invention includes a sheet feeder 10, an image forming unit 20, a sheet receiver 30, and a controller 40. In the inkjet recording device 1 controlled by the controller 40, the image forming unit 20 forms an image on a recording medium P conveyed from the sheet feeder 10 to the image forming unit 20, and then the recording medium P is ejected into the sheet receiver 30.

The sheet feeder 10 stores the recording media P on which images are to be formed and sends the recording media P to the image forming unit 20 for image formation. The sheet feeder 10 includes a sheet tray 11 and a conveyer 12.

The sheet tray 11 is a plate that can hold one or more recording media P. The sheet tray 11 shifts vertically in accordance with the volume of the recording media P placed on the sheet tray 11. The uppermost recording medium P is maintained at a position conveyable by the conveyer 12.

The conveyer 12 includes a conveying mechanism that circulates an annular belt 123 with multiple (two, for example) rollers 121 and 122 to convey the recording medium P disposed on the belt 123. The conveyer 12 also includes a supplier that transports the uppermost recording medium P placed on the sheet tray 11 to the belt 123. The conveyer 12 conveys the recording medium P transported from the supplier onto the belt 123 with the circulation of the belt 123.

The image forming unit 20 ejects ink onto the recording medium P to form an image. The image forming unit 20 includes an image-forming drum 21, a transporting unit 22, a sheet heater 23, head units 24, an irradiator 25, and a delivery unit 26.

The image-forming drum 21 carries the recording medium P on the cylindrical outer circumferential face and rotates to convey the recording medium P. The conveying face of the image-forming drum 21 faces the sheet heater 23, the head units 24, and the irradiator 25, which carry out processes for image formation on the conveyed recording medium P.

The transporting unit 22 is disposed between the conveyer 12 in the sheet feeder 10 and the image-forming drum 21 and transports the recording medium P from the conveyer 12 to the image-forming drum 21. The transporting unit 22 includes a swinging arm 221 that holds one edge of the recording medium P from the conveyer 12 and a cylindrical transporting drum 222 that transports the recording medium. P held by the swinging arm 221 to the image-forming drum 21. The recording medium P on the conveyer 12 is lifted by the swinging arm 221 and passed to the transporting drum 222, to align the recording medium P with the outer circumferential face of the image-forming drum 21 and transport the recording medium P to the image-forming drum 21.

The sheet heater 23 heats the recording medium P carried on the image-forming drum 21. The sheet heater 23 includes an infrared heater, for example, and generates heat in response to an input current. The sheet heater 23 is disposed near the outer circumferential face of the image-forming drum 21 and upstream of the head units 24 in the conveying direction of the recording medium P conveyed with the rotating image-forming drum 21. The heating of the sheet heater 23 is controlled by the controller 40 so that the recording medium P carried on the image-forming drum 21 and passing near the sheet heater 23 reaches a predetermined temperature.

The head units 24 eject ink onto the recording medium P carried on the image-forming drum 21, to form an image. The head units 24 consist of individual units of the colors cyan (C), magenta (M), yellow (Y), and black (K). With reference to FIG. 1, the head units 24 corresponding to the colors YMCK are disposed in this order from the upstream of the conveying direction of the recording medium P conveyed with the rotating image-forming drum 21.

The head units 24 according to this embodiment are disposed so that they can coat an area having a length (width) larger than that of the entire recording medium P in a direction orthogonal to the conveying direction (width direction) of the recording medium P. In other words, the inkjet recording device 1 is a single-pass inkjet recording device of a line-head type. Each of the head units 24 can be a line head consisting of aligned inkjet heads 241 (see FIG. 2).

Figure 2A:
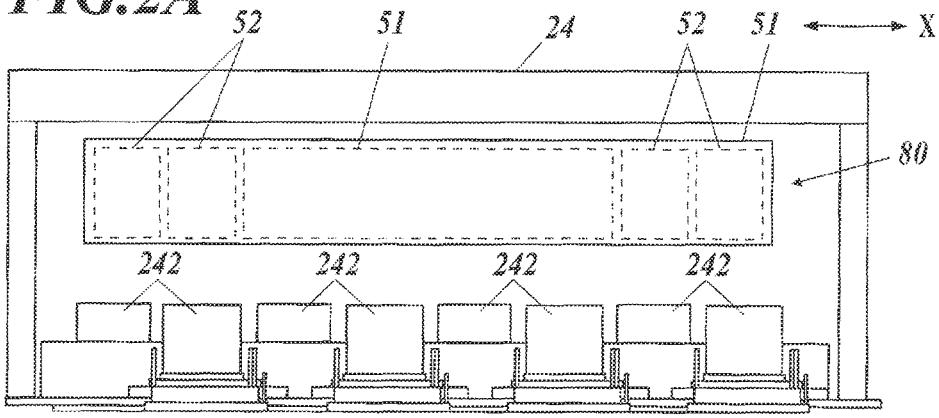
FIG. 2A is a schematic side view of an exemplary internal configuration of the head unit.
Figure 2B:
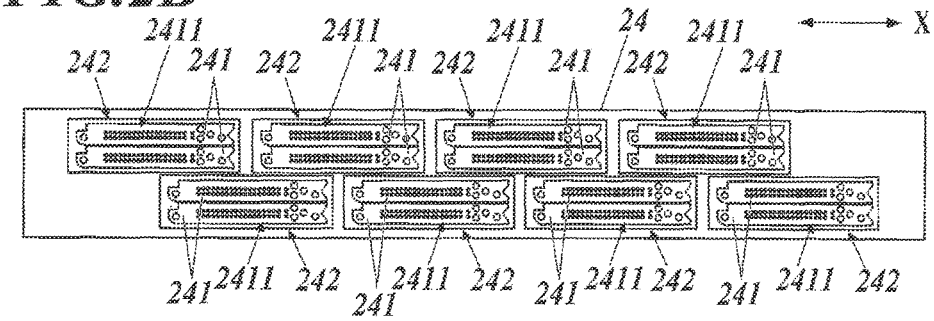
FIG. 2B is a schematic view of an exemplary internal configuration of the head unit viewed from a recording medium side.

FIGS. 2A and 2B illustrate the internal configuration of each head unit 24. FIG. 2A is a schematic side view of the internal configuration of one of the head units 24. FIG. 2B is a schematic view of the internal configuration of the head unit 24 viewed from the recording medium side. In FIG. 2A, the head units 24 are viewed from a direction orthogonal to the vertical direction of the head units 24 and orthogonal to the perpendicular direction (the X direction) of the plane of FIG. 1.

The head unit 24 includes multiple inkjet heads 241, as illustrated in FIGS. 2A and 2B. In the drawings, each head unit 24 includes sixteen inkjet heads 241. The sixteen inkjet heads 241 are paired to provide eight inkjet modules 242.

The inkjet heads 241 each have multiple nozzles 2411. The inkjet heads 241 eject ink from the nozzles 2411 to form an image on the recording medium P carried on the image-forming drum 21. That is, the inkjet heads 241 are disposed such that the nozzles 2411 are exposed at the lower face of the head unit 24. Each inkjet head 241 illustrated in FIG. 2B has two arrays of the nozzles 2411 extending in the X direction.

The inkjet modules 242 are arrayed into two groups extending in the X direction, for example, as illustrated in FIG. 2B. The two arrays of the inkjet modules 242 are disposed such that the inkjet modules 242 are arranged in a staggered manner in the direction orthogonal to the X direction.

Each head unit 24 includes an ink heating device 80 that heats the ink to be fed to the inkjet heads 241. The ink heating device 80 will be described in detail below.

The irradiator 25 emits active energy beams to cure the ink ejected onto the recording medium P in the inkjet recording device 1 according to this embodiment. The irradiator 25 includes a fluorescent tube, such as a low-pressure mercury lamp, for example, which emits active energy beams such as ultraviolet (UV) rays. The irradiator 25 is disposed near the outer circumferential face of the image-forming drum 21 and downstream of the head units 24 in the conveying direction of the recording medium P conveyed with the rotating image-forming drum 21. The irradiator 25 radiates active energy beams onto the recording medium P carried on the image-forming drum 21 and with the ink ejected and cures the ink on the recording medium P by the active energy beams.

Examples of the fluorescent tube generating UV light other than the low-pressure mercury lamp include a mercury lamp having an operational pressure in the range of several hundred pascals (Pa) to one million pascals (Pa), a light source that functions as a sterilizing lamp, a cold-cathode tube, a UV laser source, a metal halide lamp, and a light-emitting diode. Among such tubes, preferred is a light source that emits high-intensity UV light at low power (for example, light-emitting diode). In addition to UV light, any other active energy beam may be selected for curing the ink depending on the properties of the ink. The light source may also be selected depending on the wavelength of the active energy beam.

The delivery unit 26 conveys the recording medium P irradiated with active energy beams from the irradiator 25 from the image-forming drum 21 to the sheet receiver 30. The delivery unit 26 includes a conveying mechanism that circulates an annular belt 263 with rollers (two rollers, for example) 261 and 262 to convey the recording medium P on the belt 263 and a cylindrical transporting drum 264 that transports the recording medium P from the image-forming drum 21 to the conveying mechanism. The delivery unit 26 conveys the recording medium P transported onto the belt 263 from the transporting drum 264 to the sheet receiver 30 with the circulating belt 263.

The sheet receiver 30 stores the recording media P ejected from the image forming unit 20 through the delivery unit 26. The sheet receiver 30 includes a flat sheet tray 31 on which the recording medium P is placed after image formation.

The controller 40 comprehensively controls the operation of the components of the inkjet recording device 1. The controller 40 includes a central processing unit (CPU), a read-only memory (ROM), and a random-access memory (RAM). In the controller 40, various processing programs, such as a system program stored in the ROM, are read from the ROM and loaded to the RAM. The programs loaded to the RAM are executed by the CPU to carry out various control processes, such as image processing and detection of the failure of liquid feeding described above.

Any ink may be used for the inkjet recording device 1 according to this embodiment. Examples of such ink include UV curable ink. The UV curable ink exhibits a transition between a gel phase and a liquid (sol) phase depending on the temperature without UV irradiation. The ink has a predetermined phase-transition temperature within the range of approximately 40° C. to 100° C., for example. The ink uniformly liquefies (solates) when heated to temperatures higher than the phase-transition temperature. The ink gelates at temperatures lower than the predetermined phase-transition temperature including normal room temperature (0° C. to 30° C.)

The ink heating device 80 provided on each head unit 24 will now be described with reference to FIGS. 3 to 8. The ink heating device 80 includes an ink tank 50, which is an integrated unit of subtanks storing ink and disposed in the longitudinal direction, and an ink-tank heater 60 disposed on the outer face of the ink tank 50 heating the ink tank 50.

Figure 3:
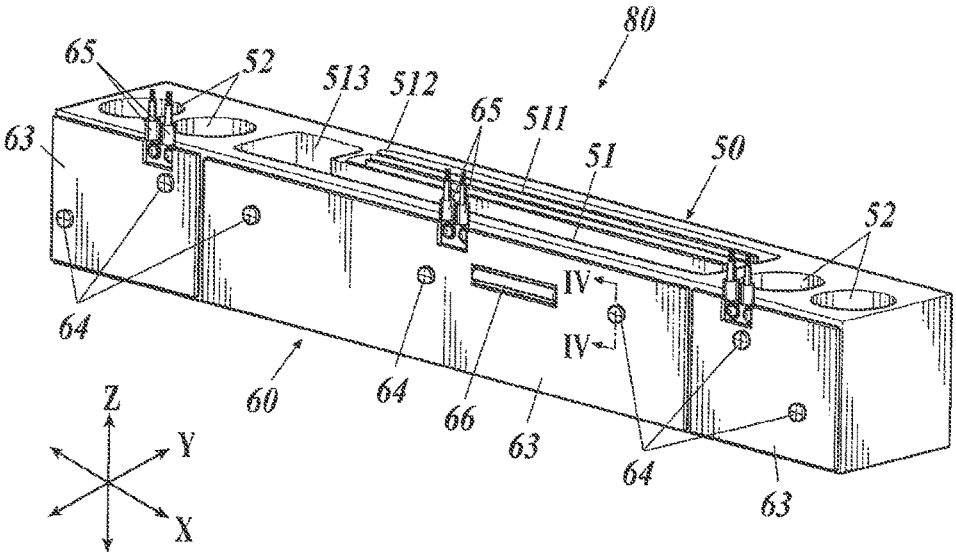
FIG. 3 is a schematic perspective view of an ink heating device.
Figure 4:
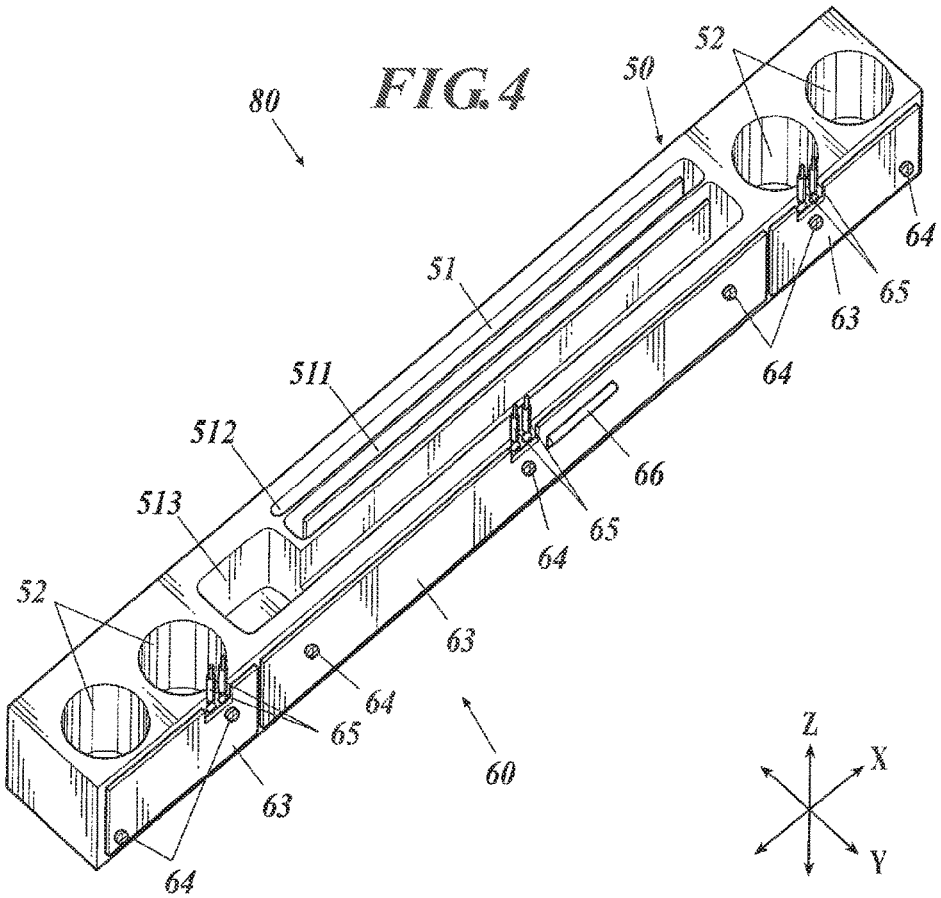
FIG. 4 is a schematic perspective view of the ink heating device.
Figure 5:
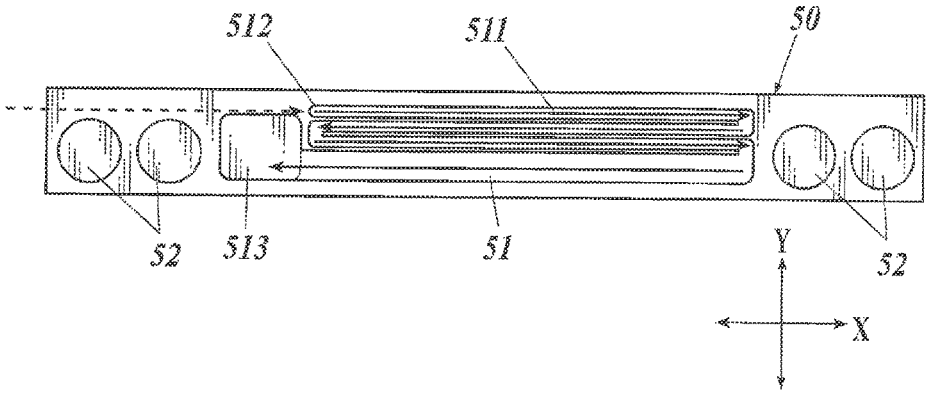
FIG. 5 is a schematic plane view of an ink tank.
Figure 6:
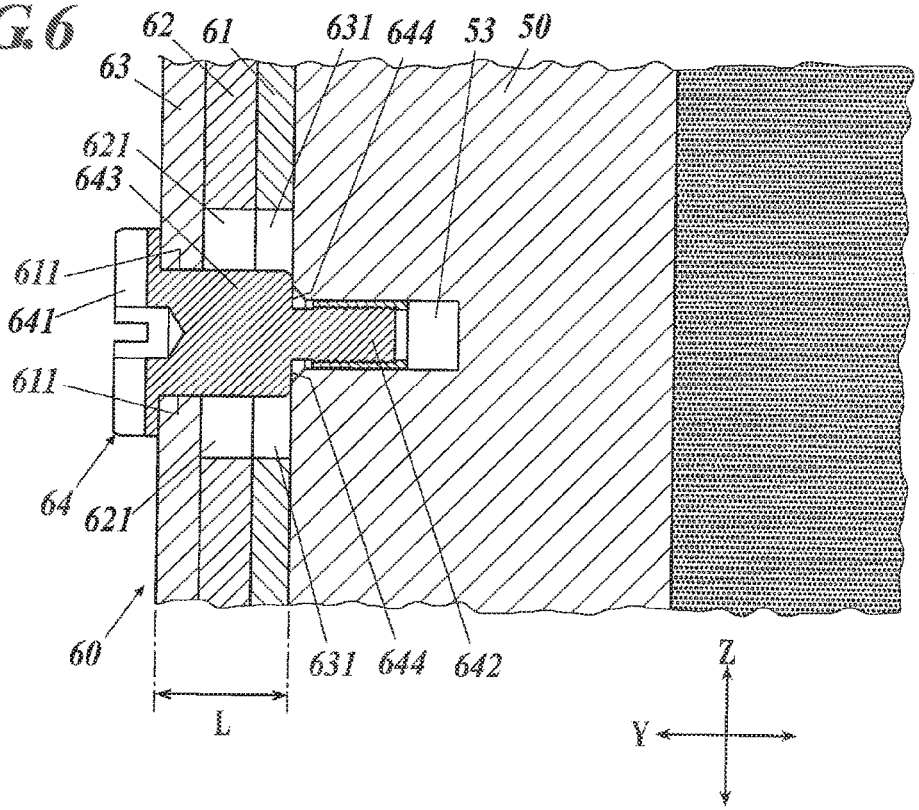
FIG. 6 is a schematic cross-sectional view of an attachment to attach an ink-tank heater to the ink tank taken along line VI-VI in FIG. 3 showing.
Figure 7:
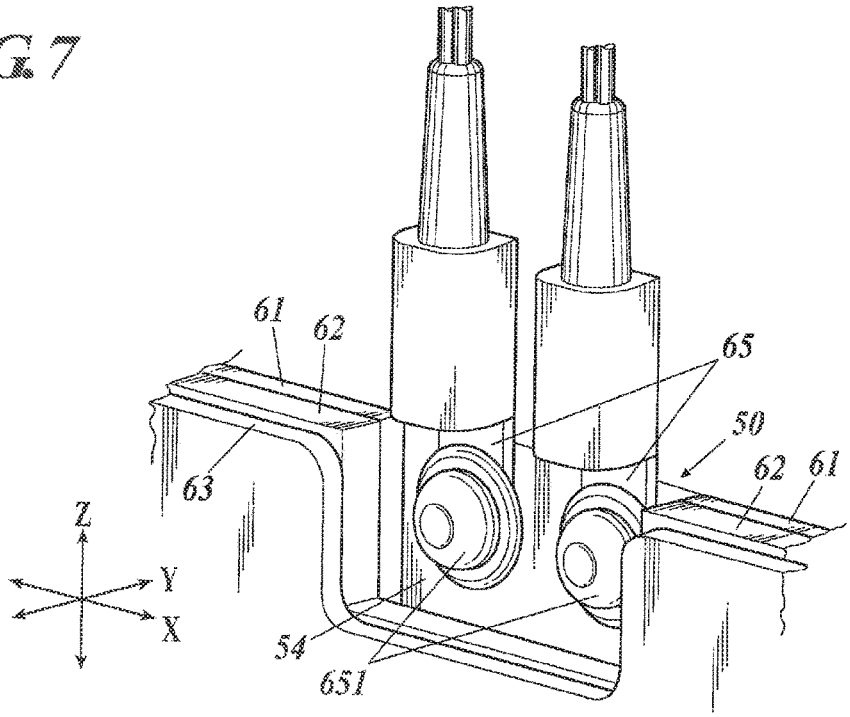
FIG. 7 is a schematic perspective view of an attachment to attach thermistors to the ink tank.
Figure 8:
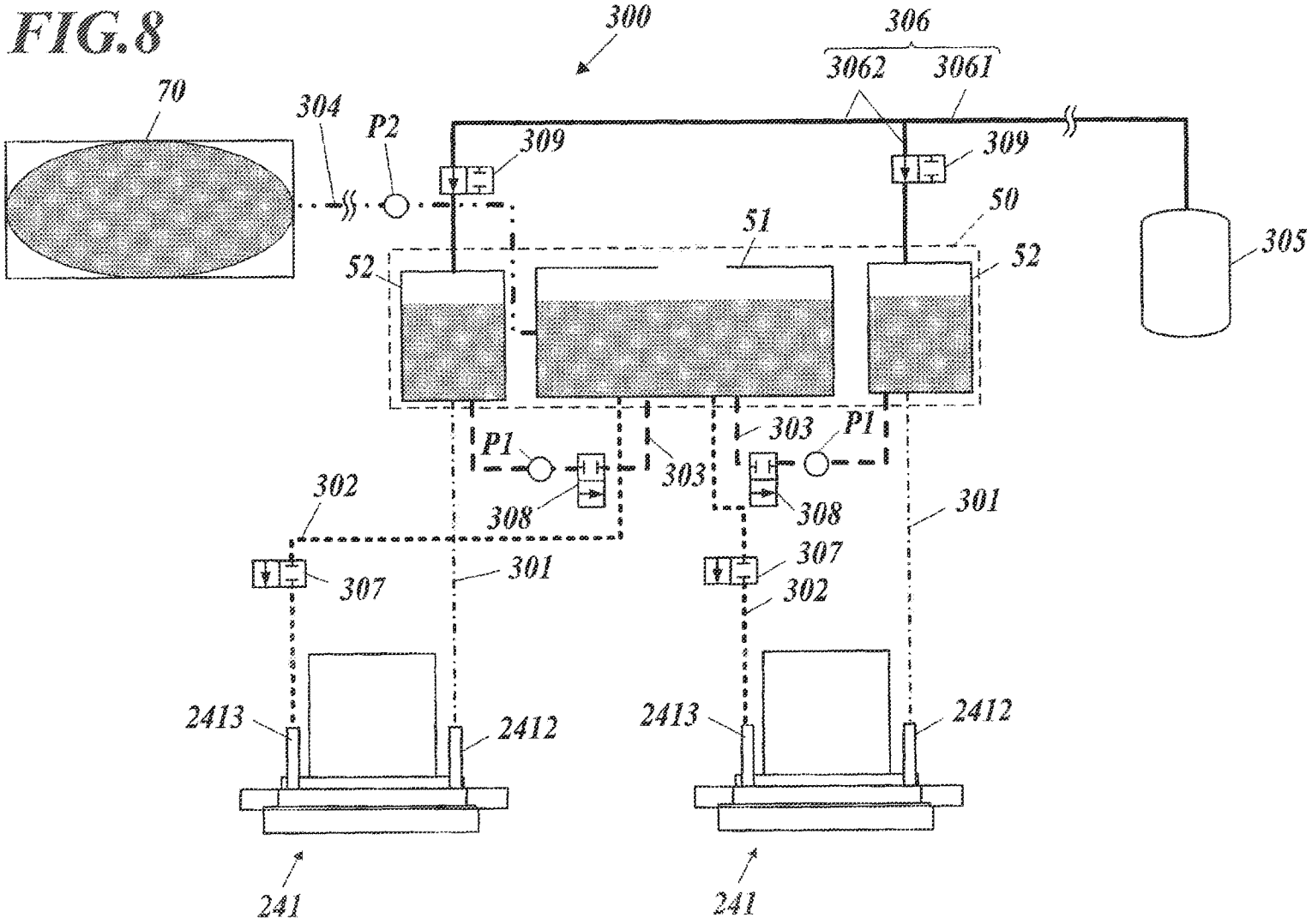
FIG. 8 is a schematic view of essential components of an ink ejecting mechanism and connections between the components of the ink ejecting mechanism.

FIGS. 3 and 4 are schematic perspective views of the ink heating device 80. FIG. 5 is a schematic plane view of the ink tank 50. FIG. 6 is a schematic cross-sectional view of the ink-tank heater 60 attached to the ink tank 50, taken along line VI-VI in FIG. 3. FIG. 7 is an enlarged schematic perspective view of an attachment of thermistors 65 illustrated in FIG. 3. FIG. 8 is a schematic view illustrating essential components of an ink ejecting mechanism 300 including the ink tank 50 and the connections between components of the ink ejecting mechanism 300. FIG. 8 omits some of the inkjet heads 241 and second subtanks 52.

The head unit 24 provided with the ink heating device 80 ejects the ink in the "Z direction," and the "Y direction is orthogonal to the X and Z directions.

The ink tank 50 stores ink from an ink supplier 70 (see FIG. 8) and feeds the stored ink to the inkjet heads 241. The ink tank 50 collects and stores the ink remaining in the inkjet heads 241.

The ink tank 50 is an elongated component extending in the X direction. The ink tank 50 is an integrated unit of a first subtank 51 and four second subtanks 52. The first subtank 51 and the four second subtanks 52 are disposed along the longitudinal direction of the ink tank 50.

With reference to FIGS. 3 to 5, the first subtank 51 is a depression disposed in the central area of the ink tank 50 extending in the longitudinal direction. The first subtank 51 stores the ink from the ink supplier 70 and collects and stores the ink from the inkjet heads 241. The first subtank 51 has a meandering flow channel 511 through which the supplied ink flows in the directions indicated by the solid arrows in FIG. 5. One end of the flow channel 511 has an intake portion 512 that receives the ink from the ink supplier 70 or the inkjet heads 241 in the direction indicated by the dotted arrow in FIG. 5. A storage portion 513 is disposed on the other end of the flow channel 511 to store the ink passing through the flow channel 511 and supply the stored ink to the second subtanks. In this way, the ink from the intake portion 512 flows through the flow channel 511 in a meandering pattern indicated by the arrows in FIG. 5 and is stored in the storage portion 513. The ink in the storage portion 513 is fed to the second subtanks 52 with pumps P1 (see FIG. 8).

Two second subtanks 52, which store the ink from the first subtank, are depressions disposed at each longitudinal end of the ink tank 50, as illustrated in FIGS. 3 to 5. The ink stored in the second subtanks 52 is fed to two of the eight inkjet modules 242 of the head unit 24. This allows maintenance of the eight inkjet modules 242 of the head unit 24 in units of two.

The number of second subtanks 52 may be any appropriate number other than four depending on the number of inkjet modules 242 of the head unit 24.

The ink-tank heater 60 is attached to the ink tank 50 so as to entirely cover one side of the ink tank 50, as illustrated in FIGS. 3 and 4. With reference to FIG. 6, the ink-tank heater 60 includes planer heating members (heaters) 61 disposed on the outer face of the ink tank 50; elastic members 62 disposed on the respective planer heating members 61 on the faces opposite to the ink tank 50; metal plates (flat members) 63 disposed on the respective elastic members 62 on the faces opposite to the planer heating members 61; fixing screws (pressure fixing members) 64 that press the respective metal plates 63 toward the ink tank and fix the respective metal plates 63; thermistors 65 in contact with the ink tank 50; and the controller 40 that individually controls the heating temperatures of the planer heating members 61. With reference to FIGS. 3 and 4, the planer heating members 61, the elastic members 62, the metal plates 63, the fixing screws 64, and the thermistors 65 are disposed at three positions, i.e., in the central area and at the both longitudinal ends of the ink tank 50. The planer heating members 61 and other components are disposed at the positions each corresponding to the first subtank 51 disposed in the central area of the ink tank 50 and the second subtanks 52 disposed at the both longitudinal ends of the ink tank 50.

With reference to FIG. 6, the planer heating members 61, which are in direct contact with the outer face of the ink tank 50, heat the outer face of the ink tank 50 to heat the ink inside the ink tank 50. A lubricant, such as grease, may be applied between the planer heating members 61 and the ink tank 50. Alternatively, the lubricant may be omitted to prevent an increase in processes for production of the inkjet recording device 1 and repair and replacement of the ink-tank heater 60. The temperature of the planer heating members 61 is controlled by the controller 40 in response to the temperature detected by the thermistors 65.

The planer heating members 61 are heaters, specifically rubber heaters, each composed of a planar thermal insulator and a corrugated heating element strips disposed on the thermal insulator sheet, for example. The rubber heaters have increased adhesion to the ink tank 50, which leads to a reduction in production costs.

Each elastic member 62 is disposed between the corresponding planer heating member 61 and the corresponding metal plate 63, as illustrated in FIG. 6. The elastic member 62 is pressed with the corresponding fixing screw 64 via the metal plate 63 and thus is elastically deformed in the thickness direction (Y direction). The restoring force of the elastic member 62 applies a substantially uniform strength to the planer heating member 61 in the plane (XZ plane) to press the planer heating member 61 toward the ink tank 50. The elastic member 62 may be composed of any material that elastically deforms in response to pressing by the fixing screw 64 and elastically presses the planer heating member 61. Examples of such a material include rubber, sponge, and other spongy or porous materials.

The metal plate 63 is in contact with the elastic member 62 and serves as the outer face of the ink-tank heater 60, as illustrated in FIG. 6.

With reference to FIGS. 3, 4, and 6, the fixing screws 64 pass through the respective metal plates 63 disposed in three positions along the longitudinal direction of the ink tank 50 to fix the respective metal plates 63 to the ink tank 50. In the examples illustrated in FIGS. 3 and 4, three fixing screws 64 are provided for the metal plate 63 in the central area of the ink tank 50, and two fixing screws 64 are provided for each of the metal plates 63 at the longitudinal ends of the ink tank 50. The number and position of the fixing screws 64 provided for each of the metal plates 63 should not be limited to those illustrated in the drawings. Any number of the fixing screws 64 may be provided at any position to press and fix the metal plates 63 to the ink tank 50.

Each of the fixing screws 64 includes a head 641, a shaft 642, and a spacer 643 having a diameter smaller than that of the shaft 642 and larger than that of the head 641, the spacer 643 being disposed between the head 641 and the shaft 642 in the axial direction, as illustrated in FIG. 6. The fixing screw 64 is fixed to the ink tank 50 by screwing the shaft 642 into an internal thread 53 provided in the outer wall of the ink tank 50 and through the planer heating member 61, the elastic member 62, and the metal plate 63. The shaft 642 of the fixing screw 64 is screwed into the outer wall of the ink tank 50 by a predetermined length, and the end face 644 of the spacer 643 comes into contact with the outer face of the ink tank 50, to prevent further insertion of the shaft 642 into the internal thread 53.

With reference to FIG. 6, the planer heating member 61, the elastic member 62, and the metal plate 63 have holes 611, 621, and 631, respectively, for passing the fixing screw 64. The diameter of the hole 611 in the planer heating member 61 and the diameter of the hole 621 in the elastic member 62 are sufficiently larger than the diameter of the spacer 643, and the diameter of the hole 631 in the metal plate 63 is substantially identical to the diameter of the spacer 643. This facilitates the insertion of the fixing screw 64 to the planer heating member 61 and the elastic member 62 during attachment of the fixing screw 64. After attachment of the fixing screw 64, the head 641 of the fixing screw 64 comes into contact with the metal plate 63 to certainly press the metal plate 63 toward the ink tank 50, and prevent displacement of the metal plate 63 in the plane (XZ plane).

The spacer 643 of the fixing screw 64 has an axial length L that is smaller than the sum of the thicknesses of the planer heating member 61, the elastic member 62 before elastic deformation, and the metal plate 63, as illustrated in FIG. 6. Thus, screwing of the shaft 642 of the fixing screw 64 into the internal thread 53 via the holes 611, 621, and 631 causes the head 641 and the ink tank 50 to clamp the planer heating member 61, the elastic member 62, and the metal plate 63. The metal plate 63 in contact with the head 641 is thereby pressed toward the elastic member 62. This causes elastic deformation of the elastic member 62, and the restoring force of the elastic member 62 presses the planer heating member 61 toward the ink tank 50.

Adjustment of the axial length L of the spacer 643 can adjust the degree of elastic deformation of the elastic member 62 in the thickness direction, and thus determine appropriate restoring force of the elastic member 62 applied to the planer heating member 61.

The thermistors 65 are in contact with the ink tank 50, as illustrated in FIG. 7. Specifically, the edges of the planer heating member 61, the elastic member 62, and the metal plate 63 have cutouts through which the ink tank 50 is exposed. The thermistors 65 are fixed to the exposed portion 54 with screws 651. Alternative to fixing the thermistors 65 with the screws 651, the thermistors 65 may be in the form of thin films and be disposed between the ink tank 50 and the planer heating members 61. Two thermistors 65 are provided side by side on the exposed portion 54, one of which is provided as a backup.

The ink-tank heater 60 also includes a thermostat 66. The thermostat 66 operates in response to excessively high temperatures of the planer heating members 61 to terminate feeding of the current to the planer heating members 61. The thermostat 66 can effectively prevent damage of the planer heating members 61 due to an excessive temperature rise.

As described above, the planer heating members 61, the elastic members 62, the metal plates 63, the fixing screws 64, and the thermistors 65 are disposed at three positions on a side of the ink tank 50, i.e., in the central area and at the both longitudinal ends of the ink tank 50. The heating temperatures of the planer heating members 61 are independently controlled by the controller 40. Specifically, the controller 40 controls the heating temperatures of the planer heating members 61 at the both longitudinal ends of the ink tank 50 to be higher than the heating temperature of the planer heating member 61 in the central area of the ink tank 50.

Since the ink tank 50 is an elongated component, heat radiation from the both longitudinal ends is higher than that in the central area, and thus, the temperatures of the ink accommodated at the ends readily decrease compared to that at the central area. The second subtanks 52 that feed ink to the inkjet heads 241 are disposed at the both longitudinal ends of the ink tank 50. Thus, a decrease in temperature at the longitudinal ends of the ink tank 50 may cause ejection failure due to low-temperature ink fed to the inkjet heads 241. In this embodiment, the controller 40 controls the temperatures of the planer heating members 61 at the both longitudinal ends of the ink tank 50 to be higher than the temperature of the planer heating member 61 in the central area of the ink tank 50. Thus, the ink inside the second subtanks 52 is evenly and sufficiently heated, and low-temperature ink is prevented from being fed to the inkjet heads 241. This prevents ejection failure.

In detail, the controller 40 controls the heating temperature of the planer heating members 61 at the both longitudinal ends of the ink tank 50 to be approximately 5° C. higher than that of the planer heating member 61 in the central area of the ink tank 50. Upon turning on the power supply of the inkjet recording device 1, the controller 40 starts the control of the planer heating members 61 and maintains a constant heating temperature in accordance with the volume of the ink to be ejected from the inkjet heads 241.

The ink ejecting mechanism 300 of the inkjet recording device 1 will now be described with reference to FIG. 8.

The ink ejecting mechanism 300 includes the ink supplier 70 that supplies ink; the ink tank 50 that stores the ink from the ink supplier 70; the inkjet heads 241 that eject the ink from the ink tank 50; a pressure controller 305 that applies a negative pressure to the nozzles 2411 of the inkjet heads 241; a channel 304 that connects the ink supplier 70 and the ink tank 50; channels 303 that connect the first subtank 51 and the second subtanks 52 in the ink tank 50; supply channels 301 that connect the second subtanks 52 and the inkjet heads 241; collecting channels 302 that connect the inkjet heads 241 and the first subtank 51; and an air channel 306 that connects the second subtanks 52 and the pressure controller 305.

The ink channels are indicated by dashed lines in FIG. 8. The channels constitute a closed channel through which ink flows.

The ink supplier 70 stores the ink fed to the components of the ink ejecting mechanism 300 and feeds the stored ink to the first subtank 51 of the ink tank 50.

The first subtank 51 stores the ink from the ink supplier 70 and feeds the stored ink to the second subtanks 52. The ink to be supplied to the first subtank 51 is taken in through the intake portion 512, stored in the storage portion 513 via the flow channel 511, and fed from the storage portion 513 to the second subtanks 52.

The unheated ink at room-temperature is fed from the ink supplier 70 to the first subtank 51. The ink is then fed to the second subtanks 52 via the flow channel 511 in a certain time. During this time, the ink-tank heater 60 disposed on the exterior of the first subtank 51 sufficiently heats the ink at room-temperature in the first subtank 51. This prevents feeding of ink at a low-temperature even when a large volume ink is to be ejected from the first subtank 51 to the second subtanks 52.

The second subtanks 52 store the ink from the first subtank 51, and the stored ink is fed to the inkjet heads 241. As described above, the ink-tank heater 60 is disposed on the exterior of the second subtanks 52 and controlled by the controller 40 so that the temperatures of the planer heating members 61 at the both longitudinal ends of the ink tank 50 are higher than the temperature of the planer heating member 61 in the central area of the ink tank 50. This sufficiently heats the ink stored in the second subtanks 51 and prevents ejection failure due to feeding of the ink at low-temperature to the inkjet heads 241.

The pressure controllers 305 are connected to the respective second subtanks 52 and control the pressure in the second subtanks 52 under the control of the controller 40. In this way, the pressure controllers 305 apply a negative pressure to the nozzles 2411 of the inkjet heads 241 via the second subtanks 52 and the supply channels 301. This prevents leakage of ink from the nozzles during an intermission of image formation or various maintenance procedures.

The supply channels 301, the collecting channels 302, and the channels 303 and 304 are tubes through which ink pass. They are composed of a resin or a material having high heat-conductivity.

The channel 304 connects the first subtank 51 to the ink supplier 70 and is provided with a pump P2. The pump P2 operates under the control of the controller 40 and feeds the ink from the ink supplier 70 to the first subtank 51. The pump P2 is a positive-displacement pump, such as a diaphragm pump, or a tube pump, for example.

The channels 303 connect the second subtanks 52 to the first subtank 51 and are provided with the pumps P1. The pumps P1 operate under the control of the controller 40 and feed the ink from the first subtank 51 to the second subtanks 52. The pumps P1 are positive-displacement pumps, such as diaphragm pumps, or tube pumps, for example.

The supply channels 301 connect inlets 2412 of the inkjet heads 241 to the second subtanks 52.

The collecting channels 302 connect outlets 2413 of the inkjet heads 241 to the first subtank 51.

The air channel 306 connects the second subtanks 52 to the pressure controller 305. The air channel 306 is a tube composed of resin, for example, through which air passes. The air channel 306 includes a common subchannel 3061 connected to the pressure controller 305 and subchannels 3062 branching from the common subchannel 3061 to connect to the second subtanks 52.

The collecting channels 302, the channels 303, and the subchannels 3062 are provided with electromagnetic valves 307, 308, and 309, respectively. The electromagnetic valves 307, 308, and 309 open and close the relevant ink channels and air channels under the control of the controller 40. Specifically, the electromagnetic valves 307 provided in the collecting channels 302 open and close the collecting channels 302. The electromagnetic valves 308, which are provided in the channels 303 between the first subtank 51 and the respective pumps P1, switch connection and disconnection between the first subtank 51 and the pumps P1. The electromagnetic valves 309 provided in the subchannels 3062 switch connection and disconnection between the second subtanks 52 and the pressure controller 305.

The second subtanks 52 are containers hermetically sealed except for the various connections described above. That is, the pressure inside the second subtanks 52 varies depending on the negative pressure applied from the pressure controller 305 and/or the ink from the first subtank 51. For example, feeding ink from the first subtank 51 to the second subtanks without application of a negative pressure from the pressure controller 305 during the closed state of the electromagnetic valves 309 causes an increase in pressure in the second subtanks 52 due to an increase in the volume of ink inside the second subtanks 52.

In contrast, the first subtank 51 is a container open to the exterior and thus maintains an atmospheric pressure during a variation in the volume of ink.

The ink-tank heater 60 according to the embodiment described above includes the planer heating members 61 disposed on the external face of the ink tank 50; the elastic members 62 disposed on the faces of the respective planer heating members 61 opposite to the ink tank 50; the metal plates 63 disposed on the faces of the respective elastic members 62 opposite to the planer heating members 61; and the fixing screws 64 that press the respective metal plates 63 toward the ink tank 50 to fix the respective metal plates 63. Thus, the metal plates 63 are pressed toward the ink tank 50 with the respective fixing screw 64 and cause elastic deformation of the respective elastic members 62. The restoring force of the elastic members 62 uniformly presses the respective planer heating members 61. This brings the planer heating members 61 into tight contact with the ink tank 50, allows appropriate temperature control of the ink tank 50 with the planer heating members 61, and achieves efficient heating of the ink tank 50.

The tight contact of the planer heating members 61 to the ink tank 50 prevents formation of a gap or air layer therebetween. This prevents an excess increase in the temperature of the planer heating members 61 and damage to the planer heating members 61.

The planer heating members 61, the elastic members 62, the metal plates 63, and the fixing screws 64 are disposed at three positions on the ink tank 50, i.e., in the central area and at the longitudinal ends. Thus, the heating temperatures of the planer heating members 61 can be controlled to provide a temperature gradient in the longitudinal direction of the ink tank 50, as required.

The controller 40 independently controlling the heating temperatures of the planer heating members 61 can maintain an appropriate temperature of the ink inside the ink tank 50.

The planer heating members 61, which are rubber heaters, can reduce production costs and have increased adhesion to the ink tank 50.

The ink heating device 80 includes the ink tank 50, which is an integrated unit of the first subtank 51 and the second subtanks 52 disposed along the longitudinal direction, and the planer heating members 61, which heats the ink tank 50. The planer heating members 61 heats the both longitudinal ends of the ink tank 50 to a temperature higher than the temperature of the central area of the ink tank 50. Thus, the longitudinal ends of the ink tank 50, which have high heat radiation, can be heated to high temperatures. This reduces uneven heating of the ink distributed across the longitudinal direction of the ink tank 50.

The ink tank 50 includes the first subtank 51, which is disposed in the central area, and the second subtanks 52, which are disposed at the longitudinal ends and feed ink to the inkjet heads 241. The planer heating members 61 heat the second subtanks 52 to a temperature higher than that of the first subtank 51. Thus, the ink can be maintained at a high temperature immediately before being fed to the inkjet heads 241. This prevents ejection failure of ink due to feeding of ink at a low temperature to the inkjet heads 241.

The first subtank 51 has the meandering flow channel 511 through which ink flows and the storage portion 513, which stores the ink passing through the flow channel 511 and feeds the stored ink to the second subtanks 52. Thus, the ink fed to the first subtank 51 can be sufficiently heated by the planer heating members 61. This can prevent feeding of ink at a low temperature to the second subtanks 52 even when large volumes of the ink are ejected. This certainly prevents ejection failure of ink.

In the embodiment described above, the planer heating members 61 are disposed on the outer face of the ink tank 50 at three positions, i.e., the central area and the both longitudinal ends. Alternatively, one planer heating member 61 may cover the entire longitudinal length of a side of the ink tank 50 or two planer heating members 61 may cover the entire longitudinal length of a side of the ink tank 50, for example.

Alternatively, four or more planer heating members 61 may cover the entire longitudinal length of a side of the ink tank 50. In such a case, it is preferred that the controller 40 controls the temperatures of the planer heating members 61 at the both longitudinal ends of the ink tank 50 to be higher than that of the planer heating member 61 in the central area of the ink tank 50, as described above.

In the embodiments described above, the controller 40 independently controls the heating temperatures of the three planer heating members 61. Alternatively, the temperatures may be controlled in any other way. For example, the three planer heating members 61 may be an integrated unit having a low wiring density of the heating element strips of the planer heating member 61 in the central area of the ink tank 50 and a high wiring density at the both longitudinal ends of the ink tank 50. This increases the heating temperatures at the both longitudinal ends to be higher than that of the central area of the ink tank 50.

In the embodiments described above, the ink-tank heater 60 includes three planer heating members 61, three elastic members 62, and three metal plates 63, disposed on the ink tank 50 along the longitudinal direction. Alternatively, these components may be provided in any number. For example, three planer heating members 61 may be entirely covered with one elastic member 62 and one metal plate 63, or three planer heating members 61 may be entirely covered with two or more elastic members 62 and two or more metal plates 63.

In the embodiments described above, the flat members are metal plates 63. Alternatively, the flat members may be composed of any material other than metal that has rigidity sufficient for transmitting the pressing force of the fixing screws 64 to the elastic members 62. For example, the flat members may be composed of resin.

In the embodiments described above, the pressure fixing members are fixing screws 64. Alternatively, the pressure fixing members may be any component that can fix the metal plates 63 being pressed toward the ink tank 50. For example, the pressure fixing members may be snap locks.

In the embodiments described above, the ink-tank heater 60 includes the thermistors 65. Alternatively, any other temperature detectors may be used that can be attached to the ink tank 50 or the planer heating members 61. For example, the detectors may include thermocouples that are disposed between the external wall of the ink tank 50 and the planer heating members 61. The ink-tank heater 60 may be free from detectors, such as the thermistors 65.

In the embodiments described above, the planer heating members 61 are disposed on the outer face of the ink. Alternatively, the planer heating members 61 may be disposed inside the ink tank 50 or without contact with the ink tank 50. The planer heating members 61 without contact with the ink tank 50 may include heaters that are non-planar or heat sources that radiate infrared rays.

INDUSTRIAL APPLICABILITY

The present invention can be applied to ink heating devices and inkjet recording devices.

REFERENCE SIGNS LIST

1 inkjet recording device
40 controller
50 ink tank
51 first subtank
52 second subtank
60 ink-tank heater
61 planer heating member (heater)
62 elastic member
63 metal plate (flat member)
64 fixing screw (pressure fixing member)

80 ink heating device
241 inkjet head
511 flow channel
513 storage portion

The invention claimed is:

1. An ink heating device that is disposed on an inkjet recording device and heats ink, comprising:

an ink tank that is an integrated unit of subtanks storing ink disposed along longitudinal direction; and at least one heater that heats the ink tank, wherein the at least one heater heats both longitudinal ends of the ink tank to a temperature higher than a temperature of a central area in the longitudinal direction of the ink tank, and wherein the at least one heater comprises three heaters disposed in the central area and the both longitudinal ends of the ink tank, and the ink heating device further comprises a controller that independently controls heating temperatures of the heaters.

2. The ink heating device according to claim 1, wherein, the ink tank comprises:

a first subtank that is disposed in the central area; and second subtanks that are disposed in the both longitudinal ends and feed ink to an inkjet head of the inkjet recording device, and the at least one heater heat the second subtanks to temperatures higher than a temperature of the first subtank.

3. The ink heating device according to claim 2, wherein the first subtank comprises a meandering flow channel through which ink flows and a storage portion that stores the ink from the flow channel and feeds the ink to the second subtanks.

4. The ink heating device according to claim 1, wherein the at least one heater is disposed on the external face of the ink tank.

5. The ink heating device according to claim 4, wherein, the at least one heater is a planar heating member, and the ink heating device further comprises:

an elastic member that is disposed on a face of the planer heating member opposite to the ink tank;

a flat member that is disposed on a face of the elastic member opposite to the planer heating member; and a pressure fixing member that presses the flat member toward the ink tank.

6. An inkjet recording device comprising:

the ink heating device according to claim 1; and an inkjet head that ejects ink heated by the ink heating device onto a recording medium.

* * * * *